United States Patent [19]

Gonda et al.

[11] Patent Number: 4,550,329

[45] Date of Patent: Oct. 29, 1985

[54] HEAT SENSITIVE RECORD MATERIAL

[75] Inventors: Michihiro Gonda, Kitamoto; Katsumasa Kitsukawa, Tokyo; Susumu Suzuka, Yono; Mikiko Kanasugi; Yutaka Sato, both of Tokyo; Kikuo Otomo, Toride, all of Japan

[73] Assignee: Hodogaya Chemical Co., Ltd., Tokyo, Japan

[21] Appl. No.: 646,091

[22] Filed: Aug. 31, 1984

[30] Foreign Application Priority Data

Sep. 30, 1983 [JP] Japan ..... 58-180474
Jul. 6, 1984 [JP] Japan ..... 59-138890

[51] Int. Cl.[4] ..... B41M 5/18

[52] U.S. Cl. ..... 346/214; 346/216; 346/217; 346/225; 427/150; 427/151

[58] Field of Search ..... 346/216, 217, 214, 225; 427/150, 151, 152

[56] References Cited

U.S. PATENT DOCUMENTS 4,379,721 4/1983 Qualitz et al. ..... 346/225
4,426,424 1/1984 Arai et al. ..... 346/216

FOREIGN PATENT DOCUMENTS 0041990 3/1982 Japan ..... 346/216
0203590 12/1982 Japan ..... 346/216
WO83/03225 9/1983 PCT Int'l Appl. ..... 346/225

*Primary Examiner*—Bruce H. Hess
*Attorney, Agent, or Firm*—Oblon, Fisher, Spivak, McClelland & Maier

[57] ABSTRACT

A heat sensitive record material comprising at least one colorless or light-colored electron donative dyestuff and at least one color developing agent represented by the general formula:

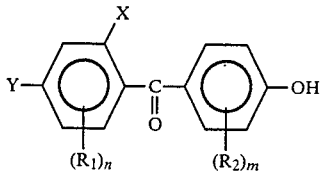

where each of $R_1$ and $R_2$ is hydrogen atom, an alkyl group having from 1 to 5 carbon atoms, an alkoxy group having from 1 to 5 carbon atoms or a halogen atom, X is an alkyl group having from 1 to 5 carbon atoms or a halogen atom, Y is a hydroxyl group, an alkyl group having from 1 to 5 carbon atoms or a halogen atom, n is an integer of 1 to 3, and m is an integer of 1 to 4.

9 Claims, No Drawings

HEAT SENSITIVE RECORD MATERIAL

The present invention relates to a heat sensitive record material, and particularly to a heat sensitive record material having excellent heat and water resistnace and improved heat sensitivity characteristics. More particularly, it relates to a heat sensitive record material having improved color-forming sensitivity and shelf stability.

It is desired that the record layer of the heat sensitive record material has no tendency for self-color development, minimum pressure sensitivity, good heat sensitivity, good light resistance, good heat decolorization resistance, good humidity decolorization resistance and good water resistance. However, there has been no record layer which completely satisfies these desired properties.

As specific examples of electron accepting compounds used in heat sensitive record materials, there have been known phenol compounds, organic acids or their metal salts, and hydroxy benzoic acid esters. Among them, phenol compounds have been widely used.

More specifically, there may be mentioned 4-t-butylphenol, 4-phenylphenol, 2,2'-hydroxylphenol, methyl p-hydroxy benzoate, 2,2-bis(4-hydroxyphenyl)-propane[bisphenol A], 4,4'-isopropylidene bis(2-methylphenol), 4,4'-isobutylidene diphenol, and bis-4-hydroxyphenyl sulfone. However, these phenol compounds are not necessarily satisfactory for the heat sensitive record materials. Namely, these phenol compounds have drawbacks that when combined with colorless electron donative dyestuffs, they provide inadequate developed color density and poor image stability. For the improvement of the image stability, it has been proposed to incorporate a sensitizer, a developer or a storage stabilizer into the color developing agent, as follows.

As a method for improving the light resistance, Japanese Examined Patent Publication No. 23205/1978 discloses an addition of a ultraviolet absorber such as 2-hydroxy-4-chlorobenzophenone.

Further, as a method for improving the moisture and heat resistant shelf stability and the plasticizer resistance, Japanese Unexamined Patent Publication No. 146689/1982 discloses a method of incorporating a benzophenone derivative such as 2,4-dihydroxybenzophenone, or Japanese Unexamined Patent Publication No. 193388/1982 discloses a method of incorporating a benzophenone derivative such as 4-hydroxybenzophenone.

The present inventors have prepared heat sensitive recording sheets in accordance with the conventional methods and the methods disclosed in the above-mentioned Patent Publications by using known colorless electron donative dyestuffs as color formers, and have tested them for the properties required for heat sensitive recording sheets. However, none of them was found to have excellent color-forming sensitivity and shelf stability such as moisture and heat resistance. Thus, none of them was found practically useful as a heat sensitive recording sheet.

It is an object of the present invention to provide a heat sensitive recording sheet wherein the above-mentioned properties are improved.

The present inventors have conducted extensive researches on the heat sensitive record materials wherein known colorless electron donative dyestuffs are used with an aim to overcome the above-mentioned drawbacks, and have finally accomplished the present invention.

Namely, the present invention provides a heat sensitive record material comprising at least one colorless or light-colored electron donative dyestuff and at least one color developing agent represented by the general formula:

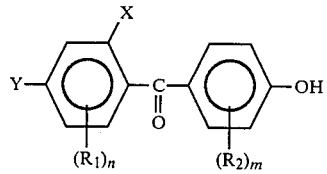

(I)

where each of $R_1$ and $R_2$ is a hydrogen atom, an alkyl group having from 1 to 5 carbon atoms, an alkoxy group having from 1 to 5 carbon atoms or a halogen atom, X is an alkyl group having from 1 to 5 carbon atoms or a halogen atom, Y is a hydroxyl group, an alkyl group having from 1 to 5 carbon atoms or a halogen atom, n is an integer of 1 to 3, and m is an integer of 1 to 4.

To the heat sensitive record material of the present invention, there may be added conventional color-developing agents such as Bisphenol A or benzyl para-hydroxybenzoate, or various sensitizers disclosed in the above-mentioned Patent Publications, as assisting agents.

Now, the present invention will be described in detail with reference to the preferred embodiments.

Specific electron accepting compounds useful as the color developing agent of the formula I of the present invention will be given below. However, the color developing agent useful for the present invention is not limited to these specific examples:

| Compound Nos. | Names of the compounds |
|---|---|
| (1) | 2-methyl-4,4'-dihydroxybenzophenone |
| (2) | 2,3-dimethyl-4,4'-dihydroxybenzophenone |
| (3) | 2,6-dimethyl-4,4'-dihydroxybenzophenone |
| (4) | bis(2-methyl-4-hydroxyphenyl)ketone |
| (5) | 2,5-dimethyl-4,4'-dihydroxybenzophenone |
| (6) | 2-methyl-2'-ethyl-4,4'-dihydroxybenzophenone |
| (7) | 2-methyl-5-t-butyl-4,4'-dihydroxybenzophenone |
| (8) | 2,5-dimethyl-3'-methyl-4,4'-dihydroxybenzophenone |
| (9) | 2-methyl-4-chloro-4'-hydroxybenzophenone |
| (10) | 2,4-dichloro-4'-hydroxybenzophenone |
| (11) | 2,4-dichloro-2'methyl-4'-hydroxybenzophenone |
| (12) | bis(2,3,5,6-tetrachloro-4-hydroxyphenyl)ketone |
| (13) | bis-(2-chloro-4-hydroxyphenyl)ketone |
| (14) | bis(2-chloro-4-hydroxyphenyl)ketone.½ hydrate |
| (15) | bis(2,3-dichloro-4-hydroxyphenyl)ketone |
| (16) | bis(2,6-dichloro-4-hydroxyphenyl)ketone |
| (17) | bis(2,5-dichloro-4-hydroxyphenyl)ketone |
| (18) | 2-chloro-4,4'-dihydroxybenzophenone |
| (19) | 2-chloro-4,4'-dihydroxybenzophenone.½ hydrate |
| (20) | 2,5-dichloro-4,4'-dihydroxybenzophenone |
| (21) | 2,5-dichloro-4,4'-dihydroxybenzophenone.½ hydrate |
| (22) | 2,3,5-trichloro-4,4'-dihydroxybenzophenone |
| (23) | 2,3,5,6-tetrachloro-4,4'-dihydroxybenzophenone |
| (24) | 2,3'-dichloro-4,4'-dihydroxybenzophenone |
| (25) | 2,2',3-trichloro-4,4'-dihydroxybenzophenone |
| (26) | 2,2',5-trichloro-4,4'-dihydroxybenzophenone |
| (27) | 2,2',6-trichloro-4,4'-dihydroxybenzophenone |
| (28) | bis(2-fluoro-4-hydroxyphenyl)ketone |
| (29) | bis(2-bromo-4-hydroxyphenyl)ketone |
| (30) | 2-fluoro-4,4'-dihydroxyphenylbenzophenone |
| (31) | 2-bromo-4,4'-dihydroxybenzophenone |
| (32) | 2-chloro-2'-fluoro-4,4'-dihydroxybenzophenone |
| (33) | 2-chloro-4-methyl-4'-hydroxybenzophenone |

-continued

| Compound Nos. | Names of the compounds |
|---|---|
| (34) | 2-chloro-2'-methyl-4,4'-dihydroxybenzophenone |
| (35) | bis(2-chloro-4-hydroxy-6-methylphenyl)ketone |
| (36) | 2-chloro-2'-methoxy-4,4'-dihydroxybenzophenone |

Among these compounds, Compound Nos. 1, 9, 10, 18, 19, 29 and 33 are preferred. Particularly preferred are Compound Nos. 1, 10, 18 and 19.

As the colorless or light-colored electron donative dyestuffs to be used in the present invention, there may be mentioned triarylmethane compounds, diphenylmethane compounds, xanthene compounds, thiazine compounds and oxazine compounds.

As specific examples of the triarylmethane compounds, there may be mentioned 3,3-bis(p-dimethylaminophenyl)-6-dimethylaminophtalide [CVL], 3,3-bis(p-dimethylaminophenyl)-phthalide, 3-(p-dimethylaminophenyl)-3-(1,3-dimethylindole-3-yl)phthalide and 3-(p-dimethylaminophenyl)-3-(2-methylindole-3-yl)phthalide.

Specific examples of the xanthene compounds include rhodamine B-anilinolactam, rhodamine(p-nitroanilino)lactam, rhodamine B(p-chloroanilino)lactam, 2-benzylamino-6-diethylaminofluoran, 2-anilino-6-diethylaminofluoran, 2-anilino-3-methyl-6-diethylaminofluoran, 2-anilino-3-methyl-6-(N-cyclohexyl-N-methyl)aminofluoran, 2-o-chloroanilino-6-diethylaminofluoran, 2-o-chloroanilino-6-dibutylaminofluoran, 2-p-chloroanilino-6-diethylaminofluoran, 2-octylamino-6-diethylaminofluoran, 2-p-acetylanilino-6-diethylaminofluoran, 2-ethoxyethylamino-3-chloro-6-diethylaminofluoran, 2-anilino-3-chloro-6-diethylaminofluoran, 2-diphenylamino-6-diethylaminofluoran, 2-anilino-3-methyl-6-(N-ethyl-N-isoamyl-)aminofluoran, 2-anilino-3-methyl-6-diphenylaminofluoran, 2-anilino-6-(N-ethyl-N-tolyl)aminofluoran and 2-anilino-3-methoxy-6-dibutylaminofluoran.

As specific examples of the thiazine compounds, there may be mentioned benzoyl-leuco-methylene blue and p-nitrobenzoyl-leuco-methylene blue.

Specific examples of the oxazine compounds include 3,7-bis(diethylamino)-10-benzoylphenoxazine and 3,7-bis(diethylamino)-10-acetylphenoxazine.

As specific examples of the spiro compounds, there may be mentioned 3-methylspirodinaphthopyran, 3-benzylspirodinaphthopyran and 3-propyl-spiro-dibenzopyran.

These compounds may be used alone or in combination as a mixture. Now, the synthesis of the color developing agents of the present invention will be described.

These compounds can readily be obtained by condensing 2 mols of a substituted phenol with 1 mol of a substituted bis(4-trichloromethylphenoxy)ketone by means of a Friedel Crafts reagent, followed by hydrolysis.

SYNTHESIS 1

Synthesis of 2-methyl-4,4'-dihydroxybenzophenone (Compound No. 1)

468 g of bis(4-trichloromethylphenoxy)ketone was dissolved in 1.5 liters of dichloromethane, and 400 g of aluminum chloride was added. After stirring the mixture, 108 g of m-cresol was dropwise added at 0° C. over a period of 1 hour and 30 minutes. The mixture was stirred at 20° C. for 3 hours, and then poured into ice water. The mixture was extracted with dichloromethane. The dichloromethane phase was separated, and the solvent was recovered. To the residue, 500 ml of a 20% NaOH aqueous solution was added, and the hydrolysis was conducted at 20° C. for 7 hours. The oil obtained by salting out with hydrochloric acid was separated and boiled with hot water. The aqueous phase was cooled whereupon slightly yellow crystals precipitated. The precipitated crystals were collected by filtration and dried at 60° C. to obtain 92 g of 2-methyl-4,4'-dihydroxybenzophenone having a melting point of from 82° to 85° C.

SYNTHESIS 2

Synthesis of 2,4-dichloro-4'-hydroxy-benzophenone (Compound No. 10)

26.5 g of 2,4-dichlorobenzotrichloride was dissolved in 150 ml of dichloromethane, and 17.5 g of aluminum chloride was added. The mixture was stirred, and 9.5 g of phenol was dropwise added at a temperature of from 0° to 3° C. over a period of 30 minutes. The mixture was stirred at 20° C. for 3 hours, and then poured into ice water. The dichloromethane phase was separated and dried. Then, the solvent was recovered, and the residual viscous substance was dissolved in an aqueous sodium hydroxide solution.

Then, the solution was neutralized with HCl, and the solid thereby obtained was dissolved in a mixture of dichloromethane and water. As the dichloromethane was distilled off, crystals precipitated. The crystals were collected by filtration, washed with 50 ml of toluene/n-hexane (a mixture of 1:1) and then dried at 60° C. to obtain 14.0 g of 2,4-dichloro-4'-hydroxybenzophenone having a melting point of from 132° to 135.5° C.

SYNTHESIS 3

Synthesis of 2-chloro-4,4'-dihydroxybenzophenone (Compound No. 18)

468 g of bis(4-trichloromethylphenoxy)ketone was dissolved in 1.5 liters of dichloromethane, and 400 g of aluminum chloride was added. The mixture was stirred, and 128 g of m-chlorophenol was dropwise added at 0° C. over a period of 1 hour 30 minutes. The mixture was stirred at 20° C. for 3 hours, and then poured into ice water. The mixture was extracted with dichloromethane. The dichloromethane phase was separated, and the solvent was recovered. To the residue, 500 ml of a 20% NaOH aqueous solution was added, and the hydrolysis was conducted at 20° C. for 7 hours. The crystals were salted out with hydrochloric acid, then recrystallized from ethanol water and dried under reduced pressure at 60° C. to obtain 165 g of 2-chloro-4,4'-dihydroxybenzophenone.½ hydrate having a melting point of from 100° to 108° C. This hydrate was dried at 110° C. for 6 hours to obtain 159 g of 2-chloro-4,4'-dihydroxybenzophenone. This compound had a melting point of from 176° to 178° C.

Now, a specific process for the preparation of a heat sensitive recording sheet wherein the heat sensitive record material of the present invention is employed, will be described.

As a binder for bonding the mixture of the color former and the color developing agent onto a support sheet, there may be employed a water soluble or water insoluble binder. As typical examples, there may be mentioned polyvinyl alcohol, methyl cellulose, hydroxyethyl cellulose, carboxy methyl cellulose, gum arabic, starch, gelatin, casein, polyvinyl pyrrolidone, a styrene-maleic anhydride copolymer, a polyacrylic acid amide, a polyacrylate, a terpene resin and a petroleum resin. Particularly suitable for the present invention are water-soluble binders. A typical water-soluble binder is polyvinyl alcohol.

From the viewpoint of the properties of the heat sensitive record sheet, it is desirable to provide a single heat sensitive layer in which the respective components i.e. at least one colorless or light-colored electron donative dyestuff as the color former and at least one benzophenone compound of the formula I, are uniformly dispersed as fine particles.

In the preparation of the heat sensitive record sheet, the record layer is composed essentially of 1 part by weight of the color former, from 2 to 10 parts by weight, preferably from 4 to 6 parts by weight, of the color developing agent of the formula I, and from 0.3 to 3 parts by weight, preferably from 0.5 to 1 part by weight, of the binder.

The color former and the color developing agent are preferably separately dispersed and pulverized in water or an organic medium containing the binder, preferably in a medium of water in which the binder is dissolved, by means of a dispersing machine such as a ball mill, a sand mill or a paint conditioner, to obtain dispersions having a particle size of from 1 to 6 μm, preferably from 3 to 5 μm. If necessary, an antifoaming agent, a dispersing agent or a brightening agent may be added at the time of the dispersing and pulverization operation.

Then, the separately prepared dispersions of the respective components are mixed together to bring the respective proportions to the above-mentioned ranges and obtain a coating composition for forming the heat sensitive recording layer. This coating composition is applied onto the surface of a support sheet by means of a wire bar #6 to #10 so that the weight of the solid after drying would be from 3 to 7 g/m$^3$, and then dried in an air-circulating dryer at a temperature of from room temperature to 70° C., to obtain a heat sensitive record sheet. If necessary, an inorganic or organic filler may be added to the coating composition to improve e.g. the anti-adhesion to the heating head or the writability with the heating head.

The heat sensitive recording sheet thus obtained is superior in the heat sensitive property, the heat decolorization resistance, the humidity decolorization resistance and the water resistance and free from the whitening phenomenon which impairs the commercial value of the heat sensitive record sheet, whereby the drawbacks inherent to the conventional heat sensitive record sheets have been overcome.

The properties of the record layer of the heat sensitive record sheet were determined by the following test methods. Namely, the color densities such as the color densities of the self-color development, color densities after the heat color development at various temperatures and the decolorization densities of the color formers left in the heated or humidified atmosphere after the heat color development, were measured by means of Macbeth RD-514 model reflective density meter. The color development was conducted at a heating temperature of from 70° to 160° C. for a heating time of 5 seconds under a load of 100 g/cm$^2$ by means of lodiaceta thermotest rhodiacita (manufactured by French National Fiber Research Institute). Further, the decolorization of the color former after the heat color development was conducted in a constant temperature and humidity testing apparatus.

Now, the present invention will be described in detail with reference to examples. However, it should be understood that the present invention is not restricted to these specific Examples.

EXAMPLE 1

Dispersion A (dispersion of a dyestuff)

2-(2-chlorophenylamino)-6-dibutylamino-fluoran: 4.0 parts
10% polyvinyl alcohol aqueous solution: 40.0 parts Dispersion B (dispersion of a developer)

A benzophenone compound of the formula I of the present invention: 7.0 parts
10% Polyvinyl alcohol aqueous solution: 40.0 parts
Water: 10.0 parts The dispersions having the above compositions were respectively pulverized in a ball mill to a particle size of from 2 to 3 μm.

Then, the dispersions were mixed in the following proportions to obtain a coating composition.

Dispersion A (dispersion of a dyestuff): 3 parts
Dispersion B (dispersion of a developer): 10 parts Further, as dispersion C, a conventional developer or a developer having a structure similar to the one of the present invention (hereinafter referred to as a "comparative developer") was likewise pulverized to a particle size of from 2 to 3 μm.

Dispersion C (dispersion of a comparative developer)

Comparative developer: 7.0 parts
10% Polyvinyl alcohol aqueous solution: 40.0 parts
Water: 10.0 parts For the purpose of comparison, dispersion A and dispersion C were mixed in the following proportions to obtain coating compositions.

Dispersion A (dispersion of a dyestuff): 3 parts
Dispersion C (dispersion of a comparative developer): 10 parts Each of these coating compositions was applied onto the surface of a sheet of high quality paper by means of a wire bar coater #10 in such an amount that the weight of the solid after drying became 5 g/m$^2$, and then dried in an air-circulating dryer.

The heat sensitive record sheet thereby obtained was subjected to various property tests for the heat sensitive record sheet. The results thereby obtained are shown in Table 1.

TABLE 1

| Color developing agent | Color density of non-developed portion*1 | | Color density of developed portion*1 | | Color-forming characteristics | |
|---|---|---|---|---|---|---|
| | Immediately after color development | After being kept under heated and humidified condition*2 | Immediately after color development | Color remaining rate after being kept under heated and humidified condition*3 | Ts (°C.)*4 | γ*4 |
| Compound No. 1 | 0.10 | 0.24 | 1.42 | 98 | 73 | 12.0 |
| Compound No. 2 | 0.12 | 0.25 | 1.24 | 91 | 93 | 7.1 |
| Compound No. 3 | 0.11 | 0.18 | 1.27 | 82 | 95 | 8.0 |
| Compound No. 4 | 0.09 | 0.19 | 1.28 | 86 | 97 | 6.4 |

TABLE 1-continued

| Color developing agent | Color density of non-developed portion*1: Immediately after color development | Color density of non-developed portion*1: After being kept under heated and humidified condition*2 | Color density of developed portion*1: Immediately after color development | Color density of developed portion*1: Color remaining rate after being kept under heated and humidified condition*3 | Color-forming characteristics: Ts (°C.)*4 | Color-forming characteristics: γ*4 |
|---|---|---|---|---|---|---|
| Compound No. 5 | 0.09 | 0.12 | 1.11 | 68 | 94 | 5.4 |
| Compound No. 9 | 0.08 | 0.13 | 1.13 | 75 | 92 | 5.7 |
| Compound No. 10 | 0.10 | 0.25 | 1.42 | 95 | 78 | 8.7 |
| Compound No. 13 | 0.06 | 0.12 | 1.36 | 92.1 | 95 | 6.4 |
| Compound No. 18 | 0.06 | 0.18 | 1.38 | 91.9 | 98 | 7.1 |
| Compound No. 19 | 0.06 | 0.15 | 1.54 | 95.2 | 88 | 8.0 |
| Compound No. 20 | 0.08 | 0.20 | 1.42 | 92.3 | 94 | 6.7 |
| Compound No. 21 | 0.08 | 0.22 | 1.44 | 94.2 | 90 | 8.2 |
| Compound No. 28 | 0.08 | 0.17 | 1.32 | 92.6 | 94 | 8.1 |
| Compound No. 29 | 0.07 | 0.12 | 1.36 | 95.6 | 93 | 6.4 |
| Compound No. 30 | 0.06 | 0.11 | 1.27 | 83.4 | 94 | 8.1 |
| Compound No. 33 | 0.06 | 0.18 | 1.23 | 93.3 | 92 | 4.9 |
| Compound No. 34 | 0.07 | 0.14 | 1.36 | 91.2 | 100 | 4.7 |
| Comparative: Bisphenol A | 0.06 | 0.14 | 1.11 | 49.5 | 121 | 3.9 |
| Comparative: 4-methyl-4'-hydroxybenzophenone | 0.08 | 0.09 | 1.03 | 35 | 131 | 3.2 |
| Comparative: 2,4'-dihydroxybenzophenone*5 | 0.10 | 0.10 | 1.25 | 26 | 101 | 5.1 |
| Comparative: 4-hydroxybenzophenone*6 | 0.10 | 0.10 | 1.34 | 15 | 106 | 5.4 |

Notes:
*1The color densities of the surface texture (i.e. non-developed portion) and the developed portion were measured by a visual filter by means of Macbeth reflective density meter RD-514 model. The heat development was conducted at a temperature of 150° C. for 3 seconds under a load of 100 g/cm$^2$.
*2Each heat sensitive record sheet was kept at 60° C. for 24 hours under a relative humidity (RH) of 80%.
*3The numerical value represents the remaining rate of the color-developed portion when the color developed under the conditions of *1 was kept under the heated and humidified condition of *2.
*4The "γ" represents a value obtained by multiplying tan θ by 100 where tan θ is the maximum inclination in the color density-color forming temperature curve in a graph in which the color density is represented by the vertical axis and the color development temperature is represented by the horizontal axis. The value "γ" represents the rising coefficient of the color development. Further, "Ts" is an intersection of the tangent at the maximum inclination with the temperature axis, and it represents the initial temperature of the color development. Further, the heat color development was conducted at a heating temperature of from 70 to 160° C. for a heating time of 5 seconds under a load of 100 g/cm$^2$ by means of lodiaceta model thermotest rhodiacita (manufactured by French National Fiber Research Institute).
*5Disclosed in Japanese Unexamined Patent Publication No. 146689/1982
*6Disclosed in Japanese Unexamined Patent Publication No. 146689/1982

EXAMPLE 2

Dispersion A (dispersion of a dyestuff) was prepared in the same manner as in Example 1.

Dispersion D (Compound No. 1 as the developer)

Compound No. 1 as the developer: 7.0 parts
10% Polyvinyl alcohol aqueous solution: 40.0 parts
Water: 10.0 parts Dispersion E (Compound No. 10 as the developer)

Compound No. 10: 7.0 parts
10% Polyvinyl alcohol aqueous solution: 40.0 parts
Water: 10.0 parts Dispersion A (dispersion of a dyestuff): 3.0 parts
Dispersion D (Compound No. 1): 5.0 parts
Dispersion E (Compound No. 10): 5.0 parts The coating composition was applied in the same manner as in Example 1, and the heat sensitive recording sheet thereby obtained was subjected to similar property tests. The results are shown in Table 2.

Another heat sensitive recording sheet was prepared in the same manner as above except that Compound No. 1 in dispersion D was replaced by Compound No. 13, and Compound No. 10 in dispersion E was replaced by Compound No. 19. This recording sheet was also subjected to similar tests, and the results are shown in Table 2.

TABLE 2

| Color developing agent | Color density of non-developed portion*1: Immediately after color development | Color density of non-developed portion*1: After being kept under heated and humidified condition*2 | Color density of developed portion*1: Immediately after color development | Color density of developed portion*1: Color remaining rate after being kept under heated and humidified condition*3 | Color-forming characteristics: Ts (°C.)*4 | Color-forming characteristics: γ*4 |
|---|---|---|---|---|---|---|
| Compound Nos. 1 and 10 | 0.12 | 0.30 | 1.48 | 99 | 75 | 8.7 |
| Compound Nos. 13 and 19 | 0.08 | 0.18 | 1.60 | 92.9 | 80 | 12.1 |

Note:
*1 to *4 are as described in respect of Table 1.

The above dispersions D and E were respectively pulverized in a ball mill to a particle size of from 2 to 3 μm.

Then, the dispersions were mixed in the following proportions to obtain a coating composition.

EXAMPLE 3

Dispersion F (dispersion of a dyestuff)

2-anilino-3-methyl-6-N-methyl-N-cyclohexylamino-fluoran: 4.0 parts

10% Polyvinyl alcohol aqueous solution: 40.0 parts

The dispersion having the above composition was pulverized in a ball mill to a particle size of from 2 to 3 μm.

This coating composition was applied in the same manner as in Example 1, and the heat sensitive recording sheet thereby obtained was subjected to similar property tests. The results are shown in Table 4.

TABLE 4

| Color developing agent | Color density of non-developed portion*1 | | Color density of developed portion*1 | | Color-forming characteristics | |
|---|---|---|---|---|---|---|
| | Immediately after color development | After being kept under heated and humidified condition*2 | Immediately after color development | Color remaining rate after being kept under heated and humidified condition*3 | Ts (°C.)*4 | γ*4 |
| Compound Nos. 1 and 10 | 0.31 | 0.52 | 1.44 | 99 | 67 | 9.9 |

Note:
*1 to *4 are as described in respect of Table 1.

Then, dispersions F and D were mixed in the following proportions to obtain a coating composition.

Dispersion F (dispersion of a dyestuff): 3.0 parts

Dispersion D (Compound No. 1 as the developer): 10.0 parts

As a Comparative Example, dispersions F and C (dispersion of a comparative developer) were mixed in the following proportions to obtain a coating composition.

Dispersion F (dispersion of a dyestuff): 3 parts

Dispersion C (dispersion of a comparative developer): 10 parts

These coating compositions were applied in the same manner as in Example 1, the heat sensitive record sheets thereby obtained were subjected to similar property tests. The results are shown in Table 3.

Another heat sensitive record sheet was prepared in the same manner as above except that Compound No. 1 in dispersion D was replaced by Compound No. 19. The record sheet was subjected to similar property tests. The results are also shown in Table 3.

EXAMPLE 5

Dispersions A, C and D were mixed in the following proportions to obtain a coating composition.

Dispersion A (dispersion of a dyestuff): 3.0 parts

Dispersion C (dispersion of a comparative developer): 5.0 parts

Dispersion D (Compound No. 1 as the developer): 5.0 parts

This coating composition was applied in the same manner as in Example 1, and the heat sensitive recording sheet thereby obtained was subjected to similar property tests. The results are shown in Table 5.

Another heat sensitive record sheet was prepared in the same manner as above except that Compound No. 1 in dispersion D was replaced by Compound No. 19. The recording sheet was subjected to similar property tests. The results are also shown in Table 5.

TABLE 5

| Color developing agent | Color density of non-developed portion*1 | | Color density of developed portion*1 | | Color-forming characteristics | |
|---|---|---|---|---|---|---|
| | Immediately after color development | After being kept under heated and humidified condition*2 | Immediately after color development | Color remaining rate after being kept under heated and humidified condition*3 | Ts (°C.)*4 | γ*4 |
| Compound No. 1 and bisphenol A | 0.08 | 0.18 | 1.39 | 88 | 81 | 9.8 |
| Bisphenol A and Compound No. 19 | 0.07 | 0.11 | 1.22 | 75.3 | 92 | 4.4 |

Note:
*1 to *4 are as described in respect of Table 1.

EXAMPLE 6

Dispersions A, C and D were mixed in the following proportions to obtain a coating composition.

TABLE 3

| Color developing agent | Color density of non-developed portion*1 | | Color density of developed portion*1 | | Color-forming characteristics | |
|---|---|---|---|---|---|---|
| | Immediately after color development | After being kept under heated and humidified condition*2 | Immediately after color development | Color remaining rate after being kept under heated and humidified condition*3 | Ts (°C.)*4 | γ*4 |
| Compound No. 1 | 0.31 | 0.48 | 1.48 | 99 | 72 | 11.4 |
| Compound No. 19 | 0.30 | 0.45 | 1.64 | 95.0 | 83.5 | 8.3 |
| Comparative: Bisphenol A | 0.23 | 0.38 | 1.24 | 53.3 | 98 | 3.8 |
| Comparative: 2,4'-dihydroxy-benzophenone | 0.18 | 0.24 | 1.42 | 30 | 75 | 8.7 |

Note:
*1 to *4 are as described in respect of Table 1.

EXAMPLE 4

Dispersions F, D and E were mixed in the following proportions to obtain a coating composition.

Dispersion F (dispersion of a dyestuff): 3.0 parts

Dispersion D (Compound No. 1): 5.0 parts

Dispersion E (Compound No. 10): 5.0 parts

Dispersion A (dispersion A of a dyestuff): 3.0 parts

Dispersion C (comparative developer): 5.0 parts

Dispersion D (Compound No. 1 as the developer): 5.0 parts

This coating composition was applied in the same manner as in Example 1, and the heat sensitive record sheet thereby obtained was subjected to similar property tests. The results are shown in Table 6.

TABLE 6

| Color developing agent | Color density of non-developed portion*1: Immediately after color development | Color density of non-developed portion*1: After being kept under heated and humidified condition*2 | Color density of developed portion*1: Immediately after color development | Color density of developed portion*1: Color remaining rate after being kept under heated and humidified condition*3 | Color-forming characteristics: Ts (°C.)*4 | Color-forming characteristics: γ*4 |
|---|---|---|---|---|---|---|
| Compound No. 1 and bisphenol A | 0.18 | 0.36 | 1.40 | 93 | 79 | 9.2 |

Note:
*1 to *4 are as described in respect of Table 1.

EXAMPLE 7

Dispersions A, F and D were mixed in the following proportions to obtain a coating composition.

Dispersion A (dispersion of a dyestuff): 1.5 parts
Dispersion F (dispersion of a dyestuff): 1.5 parts
Dispersion D (Compound No. 1 as the developer): 5.0 parts This coating composition was applied in the same manner as in Example 1, and the heat sensitive record sheet thereby obtained was subjected to similar property tests. The results are shown in Table 7.

TABLE 7

| Color developing agent | Color density of non-developed portion*1: Immediately after color development | Color density of non-developed portion*1: After being kept under heated and humidified condition*2 | Color density of developed portion*1: Immediately after color development | Color density of developed portion*1: Color remaining rate after being kept under heated and humidified condition*3 | Color-forming characteristics: Ts (°C.)*4 | Color-forming characteristics: γ*4 |
|---|---|---|---|---|---|---|
| Compound No. 1 | 0.23 | 0.48 | 1.45 | 98 | 70 | 10.2 |

Note:
*1 to *4 are as described in respect of Table 1.

From the above tables, it is evident that the heat sensitive record sheets of the present invention obtained in Examples 1 to 7 have higher developed color densities and are superior particularly in the color developing sensitivity and the shelf stability under a heated and humidified condition as compared with the comparative heat sensitive record sheets containing conventional color developing agents such Bisphenol A.

Further, the excellent color developing sensitivity and the shelf stability under heated and humidified condition were obtained even when the benzophenone compound as the color developing agent of the present invention is used in combination with the conventional developer.

What is claimed is:

1. A heat sensitive record material comprising at least one colorless or light-colored electron donative dyestuff and at least one color developing agent represented by the general formula:

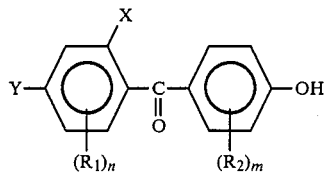

(I)

where each of $R_1$ and $R_2$ is a hydrogen atom, an alkyl group having from 1 to 5 carbon atoms, an alkoxy group having from 1 to 5 carbon atoms or a halogen atom, X is an alkyl group having from 1 to 5 carbon atoms or a halogen atom, Y is a hydroxyl group, an alkyl group having from 1 to 5 carbon atoms or a halogen atom, n is an integer of 1 to 3, and m is an integer of 1 to 4.

2. The heat sensitive record material according to claim 1, which comprises 1 part by weight of the dyestuff and from 2 to 10 parts by weight of the color developing agent.

3. The heat sensitive record material according to claim 1, wherein the color developing agent is selected from the group consisting of 2-methyl-4,4'-dihydroxybenzophenone, 2-methyl-4-chloro-4'-hydroxybenzophenone, 2,4-dichloro-4'-hydroxybenzophenone, 2-chloro-4,4'-dihydroxybenzophenone, 2-chloro-4,4'-dihydroxybenzophenone.½ hydrate, bis(2-bromo-4-hydroxyphenyl)ketone, and 2-chloro-4-methyl-4'-hydroxybenzophenone.

4. The heat sensitive record material according to claim 1, wherein the dyestuff is selected from the group consisting of a triarylmethane compound, a diphenylmethane compound, a xanthene compound, a thiazine compound and an oxazine compound.

5. A heat sensitive record sheet comprising a support sheet and a record layer formed on the support sheet, the record layer being composed essentially of at least one colorless or light-colored electron donative dyestuff, at least one color developing agent and a binder, characterized in that the color developing agent is represented by the general formula:

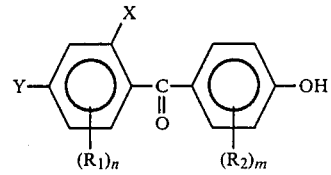

(I)

where each of $R_1$ and $R_2$ is a hydrogen atom, an alkyl group having from 1 to 5 carbon atoms, an alkoxy group having from 1 to 5 carbon atoms or a halogen atom, X is an alkyl group having from 1 to 5 carbon atoms or a halogen atom, Y is a hydroxyl group, an alkyl group having from 1 to 5 carbon atoms or a halogen atom, n is an integer of 1 to 3, and m is an integer of 1 to 4.

6. The heat sensitive record sheet according to claim 5, wherein the record layer is composed essentially of 1 part by weight of the dyestuff, from 2 to 10 parts by weight of the color developing agent and from 0.3 to 3 parts by weight of the binder.

7. The heat sensitive record sheet according to claim 5, wherein the color developing agent is selected from the group consisting of 2-methyl-4,4'-dihydroxybenzophenone, 2-methyl-4-chloro-4'-hydroxybenzophenone, 2,4-dichloro-4'-hydroxybenzophenone, 2-chloro-4,4'-dihydroxybenzophenone, 2-chloro-4,4'-dihydroxybenzophenone.½ hydrate, bis(2-bromo-4-hydroxyphenyl)ketone, and 2-chloro-4-methyl-4'-hydroxybenzophenone.

8. The heat sensitive record sheet according to claim 5, wherein the dyestuff is selected from the group consisting of a triarylmethane compound, a diphenylmethane compound, a xanthene compound, a thiazine compound and an oxazine compound.

9. The heat sensitive record sheet according to claim 5, wherein the binder is selected from the group consisting of polyvinyl alcohol, methyl cellulose, hydroxyethyl cellulose, carboxymethyl cellulose, gum arabic, starch, gelatine, casein, polyvinylpyrrolidone, a styrene-maleic anhydride copolymer, a polyacrylic acid amide, a polyacrylate, a terpene resin and a petroleum resin.

* * * * *